US006155647A

United States Patent [19]

Albecker, III

[11] Patent Number: 6,155,647

[45] Date of Patent: Dec. 5, 2000

[54] UPHOLSTERED SEAT SYSTEMS FOR LEISURE CHAIRS

[76] Inventor: Walter J. Albecker, III, 838 S. May St., Chicago, Ill. 60607-4242

[21] Appl. No.: 09/175,393

[22] Filed: Oct. 19, 1998

Related U.S. Application Data

[63] Continuation-in-part of application No. 08/492,170, Jun. 19, 1995, Pat. No. 5,836,653, which is a continuation-in-part of application No. 07/899,750, Jun. 17, 1992, Pat. No. 5,425,567.

[51] Int. Cl.[7] ..... A47C 27/00

[52] U.S. Cl. ..... 297/452.16; 297/228.12; 297/440.15; 5/633

[58] Field of Search ..... 297/218.1, 228.12, 297/352, 377, 440.11, 440.15, 452.1, 452.16, 440.1; 5/632, 633, 634, 419, 420

[56] References Cited

U.S. PATENT DOCUMENTS

| | | | |
|---|---|---|---|
| D. 167,666 | 9/1952 | Argento . | |
| 2,308,410 | 1/1943 | Winter | 297/377 |
| 2,966,205 | 12/1960 | Blaschko . | |
| 3,995,335 | 12/1976 | Neely | 5/633 |
| 4,171,549 | 10/1979 | Morrell . | |
| 4,410,214 | 10/1983 | Geschwonder | 297/440.11 X |
| 4,466,517 | 8/1984 | Spiegelman | 297/377 X |
| 4,908,891 | 3/1990 | Blagg | 5/633 X |
| 5,475,886 | 12/1995 | Mintz | 297/228.12 X |

OTHER PUBLICATIONS

Bean Chairs from various 1997 & 1998 J. C. Penney Catalogs.(May have been in existence prior to this.).

*Primary Examiner*—Peter R. Brown

[57] ABSTRACT

An upholstered seat system for use on legless leisure chairs. The seat system has features that make it particularly useful on legless leisure chairs having cushioned backrests. The seat system has a seat cushion made of an upholstery fabric filled with a soft resilient material, and further having a flap extending from the back of the seat cushion for attachment to the front lower cross member of a legless leisure chair. The flap provides a flexible means of attaching the seat cushion to the backrest that enables the seat cushion to be folded for storage or transport. The seat system also provides two lower leg support options. One option is to have a two piece seat system including the seat cushion and an ottoman cushion. The other option is to extend the seat cushion to provide continuous support from a user's buttocks to the user's heels. The ottoman cushion can be made with a slip resistant underside. Also disclosed is how the seat system can be made with a multi-layer foam filling, or other fillings.

27 Claims, 11 Drawing Sheets

UPHOLSTERED SEAT SYSTEMS FOR LEISURE CHAIRS

CROSS REFERENCE TO RELATED APPLICATION

This invention is a continuation-in-part, of application Ser. No. 08/492,170 U.S. Pat. No. 5,836,653, filed on Jun. 19, 1995 entitled: BACKRESTS/LEGLESS LEISURE CHAIRS MADE WITH A FOUNDATION which is a continuation-in-part of patent application Ser. No. 07/899,750 patent application filed on Jun. 17, 1992, now U.S. Pat. No. 5,425,567, granted Jun. 20, 1995, entitled: BACKRESTS/LEGLESS LEISURE CHAIRS AND METHODS FOR MAKING CUSHIONS, which patent is incorporated by reference herein in its entirety. Elements of the present invention including seat construction and ottoman characteristics were described in my Pertinent parts of that application are reproduced in the present application under FIGS. 6–8. The present invention is also related to my other inventions disclosed in U.S. Pat. No. 5,655,812 entitled UPHOLSTERY SYSTEM FOR CHAIRS and U.S. Pat. No. 5,825,095 entitled LEISURE CHAIR STRUCTURE.

BACKGROUND

1. Field of the Invention

This invention relates to furniture, and specifically to seat systems for legless leisure chairs that are appropriate for use on a floor or the ground.

2. Discussion of Prior Art

Presently, there are a number of solutions for making seat cushions that are used on legless leisure chairs. A number of the solutions require making the seat cushion relatively thin, or making the point of attachment virtually at the point where the face of the backrest portion of the chair contacts the floor.

U.S. Pat. No. Des. 167,666 to Argento discloses a "tele-viewing floor rest" which is in a generally wedge shape. Though no description of the seat construction is given, clearly the seat is tapered to relatively sharp edge. It also appears that the upholstery material on the seat cushion is merely a continuation of the upholstery material on the main backrest portion of the chair. The seat cushion appears to be attached to the face of the backrest.

The combined ottoman and collapsible backrest in U.S. Pat. No. 2,966,205 to Blaschko shows a seat cushion which folds. The cushions shown are relatively thin, and the pivot points seem to be a continuation of each of the cushions, such that they seem to pivot somewhat like a folding gym mat.

U.S. Pat. No. 3,995,335 to Neely discloses a backrest made of a number of pillows attached to a frame, designed to enable invalids to sit up in bed. The "seat" cushion is comprised of a rounded pillow or bumper followed by a flat portion of two ply fabric. The seat is obviously not for use on a floor.

U.S. Pat. No. 4,410,214 to Geschwonder discloses a leisure chair with a seat cushion which is covered by material which forms a pocket, and where the material which covers the seat forms integrally with the cover. While this seat has a flap, the flap is described as being for covering the outer end of the backrest frame portion. One version of this chair on the market has the seat sewn directly to the cover, with no flap. The seat cushion shown in the patent is designed to be flipped forward on the face of the backrest for storage. This would not be feasible if the backrest had a two inch thick backrest cushion on it.

U.S. Pat. No. 2,308,410 to Winter discloses a seat cushion which is very thin near the point where it attaches to the backrest frame or where some kind of flap comes out as shown in Winter's FIG. 12. The flap that extends from the seat cushion filling to the attachment point does not appear to be a continuation of the material on the side of the seat cushion shown. If the cushion filling were substantially thicker at that point, it could be difficult to sew in that manner. Winter's FIG. 6 shows the seat cushion attached to the lower edge of the upholstering. FIGS. 11, 12, and 14 show the seat cushion attached to the cross member on the base member of the frame, which is inches behind the backrest frame. The seat cushion is not wider than the frame, and in fact in FIG. 12 is shown narrower than the frame. Winter's FIG. 14 shows the seat cushion made from a continuation of the material on the backrest. The Winter chair also does not provide any cushioned support for the lower legs.

Other inventions which may relate to this field include foldable futons which are filled with foam, and have no frame. These fold in a manner similar to the way gym mats fold. The one I have studied has zippers enabling the upholstery to be sewn before the cushions are installed. There are also relatively new bean bag chair styles which have a "footrest" which consists of just a pillow type cushion filled with polystyrene pellets. Though the bean chair has a totally different seat and backrest, the footrest is similar in some respects to the ottoman of the present invention. There are however some noteworthy differences that appear to make the footrest less suitable for use with the present invention. First, the ottoman of the present invention is suitable for supporting the calves and heels of a person sitting on a leisure chair when the person stretches their legs out, and also of supporting the insoles of the feet when the person bends their knees. In order to effectively support the insoles of the feet when a person is sitting on the type of leisure chair the present invention is for, there needs to be some resistance on the part of the ottoman. While I do not wish to be bound by this, I do not see how a footrest filled with polystyrene beads and covered with vinyl could effectively support a person's feet when the insoles are pushing on the edge of the ottoman closest to the chair. Also, while I do not wish to be bound by this, I am not aware of these footrests being on the market before my application for U.S. Pat. No. 5,836,653 showing an ottoman Jun. 19, 1995. It should further be noted that my U.S. Pat. No. 5,425,567 filed in 1992 states on page 38 line 11, "Also, a specially designed type of ottoman or legrest can be used with the backrest/leisure chair." There are also ordinary chairs where a loose seat cushion simply sits on the seat decking of the chair. Obviously this does not require the seat cushion to be attached to frame. This type of seat is not very suitable for a legless leisure chair of the type referred to, because legless leisure chairs have no decking or frame underneath the seat cushion, and without attachment the seat cushion would slide away from the backrest.

All of the seat cushions for legless leisure chairs heretofore known to me have disadvantages when used with legless leisure chairs described in my previous disclosures, because they do not provide a simple relatively thick seat cushion in an attractive and very functional relationship to a cushioned backrest.

DISCUSSION OF DEVELOPMENT

During the development of the leisure chairs described in my previous applications, I have sought to make the chairs simple, have them look good, work well, and be comfortable. One of the first things I did, was try to make the seat cushion without a zipper. I had a two-fold purpose. First, the zipper on the first upholstered prototype failed, so I wanted to eliminate a problem, and second if the cushion was made without a zipper, it would save the cost of the zipper and installing the zipper. The production of seats without zippers presented difficulties in sewing. The level of skill to make the seat was relatively high when the seat cushion was higher than about 3". The thicker seat cushions are difficult to compress, and it is more difficult to close up the cushion. The early cushions had a decorative fringe going around the perimeter of the seat cushion, and it was difficult to keep the decorative fringe looking good when sewing the seat cushion closed. The present invention with the flap extending from the cushion filling provides a much more manageable way to close up the seat cushion. Additionally, the first seat cushions were attached to the legless leisure chair frame with two straps. In addition to being difficult to sew, the two straps did not seem to make the legless leisure chairs look as sophisticated as the seats described in the present invention.

To make the chairs as comfortable as possible, I experimented with various ottomans and seat sizes, shapes, and levels of firmness. With the first prototypes, I did not even use an ottoman. As I experimented with thicker seat cushions, the need for an ottoman increased. I tried ottomans that were made for ordinary types of chairs. These were pretty good, and so I was going to make a prototype that would match the chair. The prototype I was going to make was to consist of an upholstered cushion on a board, put on a frame that elevated the cushion about a foot off the floor. Before I had a chance to make the frame, I experimented with just the upholstered cushion, and determined it was good as an ottoman without the frame.

It should be generally noted that there are a number of dynamics which are substantially changed when one compares a leisure chair without a cushioned back having a relatively thin seat cushion with a leisure chair having a cushioned back on a frame with a relatively thick seat cushion. For example, normally with a thicker seat cushion (about 3" or thicker), an upholsterer ordinarily would completely sew the fabric cover with a zipper, then slip the cushion filling in and zip it shut. An upholsterer might not use a zipper with a thinner cushion. Also, the use of a cushion on a backrest frame moves the buttocks of the person sitting on the leisure chair further from the frame.

This must be considered in designing the seat. Additionally, a seat with a relatively thick cushion filling extending all the way to the attachment point becomes significantly limited in its ability to fold up or back. When a thick seat cushion is used, the dynamic is further complicated by either the displacement of the backrest cushion if the seat is filled with a cushion material all the way to the attachment point, or the relative positions of the seat cushion and the backrest cushion. It should further be noted that a thick seat cushion raises the user's buttocks and upper legs off the floor. With a thin cushion, the user's buttocks are close to the ground and most of the user's legs are generally in contact with the floor. When the thicker seat cushion is used the angle of the upper legs to the lower legs is changed with only the heel of the feet touching the ground. Additionally, when the cushion is thicker, the upper legs do not have any contact with the floor, creating the need for greater support to the upper legs and the lower legs to avoid discomfort. The present invention provides a workable solution taking into account all of the changes that occur, and provides an optimal balancing of the tradeoffs that must be made.

OBJECTS AND ADVANTAGES OF INVENTION

Accordingly, several objects and advantages of the present invention are to provide a seat system for leisure chairs with cushioned backrests having:

(a) A thickness that provides substantial cushioning and comfort, and at the same time is thin enough to enable someone sitting on the leisure chair to change positions from a reclining position to a sitting up position with legs crossed on the floor and buttocks on the seat cushion.

(b) An appropriate means for attachment to a lower cross member of a backrest frame.

(c) A design that enables folding for compactness.

(d) A design which can be relatively simple and inexpensive to manufacture.

(e) A sophisticated look.

(f) A strength and durability that would minimize the risk of tears or other failure.

(g) Width wider than the attachment point on the frame.

(h) An appropriate fit with the backrest cushion.

(I) A high level of comfort.

Further objects and advantages of my invention will become apparent from a consideration of drawings and ensuing descriptions of it.

BRIEF DESCRIPTION OF THE DRAWINGS

In the drawings, closely related figures have the same number, but different alphabetic suffixes.

DESCRIPTION OF INVENTION

Figure 1A:
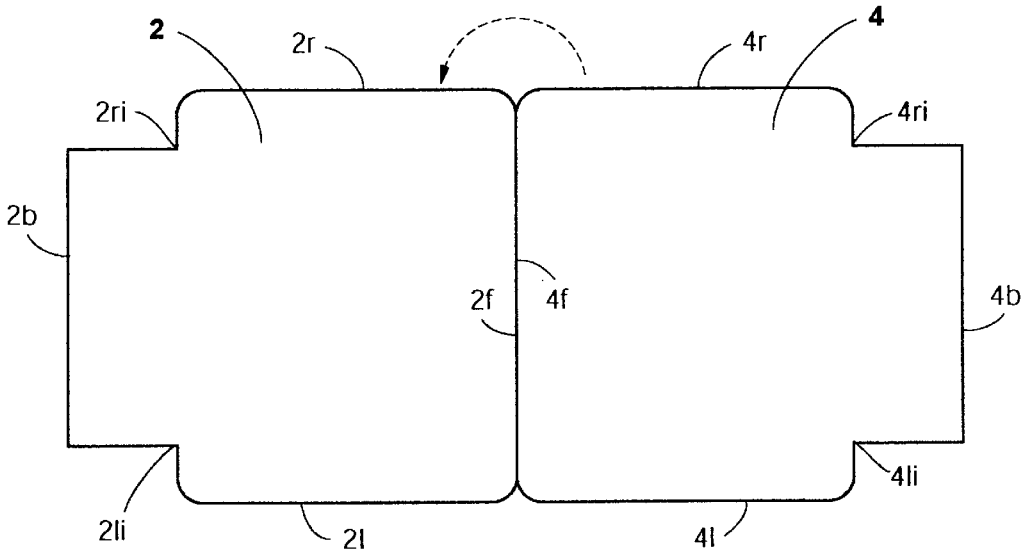
FIG. 1A is a top view of the upholstery fabric of an embodiment of the present invention shown before being sewn together.

FIG. 1A is a top view of the upholstery fabric of an embodiment of the present invention shown before being sewn together. In the drawing there is a bottom piece 2 and a top piece 4. The fabric is shown face up, and the arrow shows how the top piece 4 would be folded or placed on top of the bottom piece 2 for sewing. Typically sewing of upholstery fabric for a cushion such as this would be done or at least started with the top 4 and bottom 2 pieces of fabrics being face to face—in other words the upholstery fabric will be sewn inside out. The upholstery fabric can be made of any material used for upholstery such as but not limited to leather, vinyl, cloth, velvet, imitation suede, canvas, etc. In this application, the terms upholstery fabric and upholstery material are used to mean the same thing.

The bottom piece 2 is generally rectangular with a front 2*f*, a back 2*b*, a left side 2*l* and a right side 2*r*. In the drawing there is an indentation 2*li* on the left side 2*l* and an indentation 2*ri* on the right side 2*r*. The top piece 4 is generally rectangular with a front 4*l*, a back 4*b*, a left side 4*l* and a right side 4*r*. In the drawing there is an indentation 4*li* on the left side 4*l* and an indentation 4*ri* on the right side 4*r*. As will become clear later, the indentations are cut into the fabric to attach the seat cushion to a chair where the attachment point is not as wide as the cushion filling 3 shown in FIG. 1C. It should be noted that the indentations on each side of the fabric would be less or possibly eliminated if the attachment point on the chair was as wide or wider than the cushion.

Figure 1B:
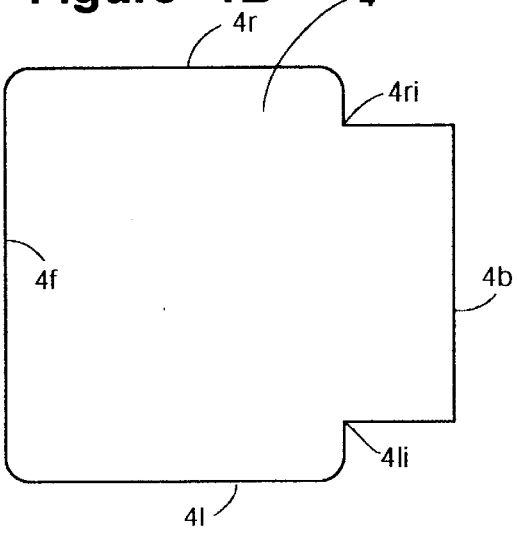
FIG. 1B is a top view of the upholstery fabric shown in FIG. 1A shown after the fabric has been sewn into a bag.

FIG. 1B is a top view of the upholstery fabric shown in FIG. 1A shown after the fabric has been sewn into a bag. After folding the top fabric 4 over the bottom fabric 2, as shown in FIG. 1A, the perimeter of the fabric is joined by sewing around the entire perimeter of the pieces of fabric 2 and 4, except the back edges 2*b* and 4*b*. After sewing the entire perimeter except for the back edges 2*b* and 4*b*, a bag is formed by the material. It should be noted that almost any method of joining the perimeters as described would work. In preferred embodiments, the method of joining is using a welt chord seam, a reinforced seam, a plain seam, a double fell with tape seam, or a top stitched after reversing seam. Of course, other upholstery methods known or to be known in the industry could be used, such as using heat to melt a plastic type material, or using an adhesive.

After the perimeter less the back edge 2*b* and 4*b* is sewn, the bag is turned inside out, making the face of the fabric now on the outside of the bag as shown.

Figure 1C:
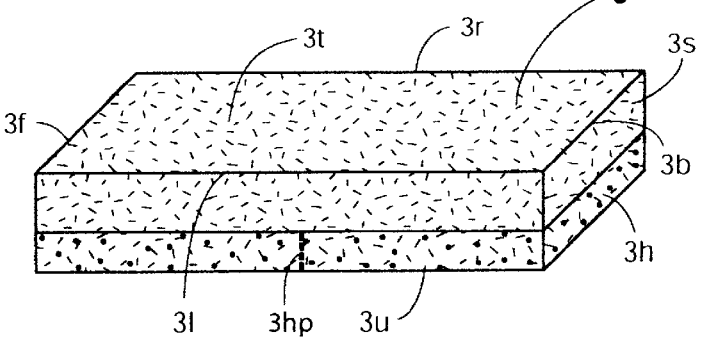
FIG. 1C an isometric view of a resilient cushion filling used for filling the bag formed by the upholstery fabric shown in FIG. 1B.

FIG. 1C is an isometric view of a soft resilient foam cushion 3 used for filling the bag formed by the upholstery fabric shown in FIG. 1B. The cushion filling 3 shown could be made of a flexible foam such as polyurethane, or of another soft material suitable for cushions. In a preferred embodiment, the cushion filling 3 is made of a HR (High Resilience) polyurethane foam with an average IFD (Indentation Force Deflection) of about 20–40 pounds. In a preferred embodiment this is accomplished by making the cushion filling 3 of two pieces 3*s* and 3*h* of foam glued together. The lower 1½" is made of a relatively high firmness foam 3*h* such as a 60 pound IFD, and the top 2½" is made of a softer foam 3*s* such as a 20–30 pound IFD. The advantage of making the cushion filling 3 this way is that if someone were to plop down on the seat, the higher firmness foam 3*h* would absorb more of the force of the landing. Another way to make the cushion is to make the lower layer using a closed cell foam of the type used on gym mats such as Ensolite1™. It is also quite possible to make the only part of the lower layer of a firmer foam, as shown in the figure as 3*hp*. In this case, only about half of the lower layer would be made of the high firmness foam, and it could start about where the dotted line 3*hp* is, and extend from that point to the back 3*b* of the resilient cushion. In this case the lower layer of foam in front of 3*hp* could be of the same firmness as the upper portion 3*s* of the resilient cushion. Plopping down is not the proper way to sit on the seat, and so in another preferred embodiment the whole cushion filling 3 is made of one firmness of foam such as one having an IFD of about 30 pounds. The numbers cited are taken from high resiliency polyurethane foams. Additionally in a preferred embodiment, the cushion filling 3 is prepared by beveling the edges and wrapping the top half with layered polyester batting. The generally rectangular cushion filling 3 is about 4" high (from top 3*t* to underside 3*u*), about 20" from front 3*f* to back 3*b*, and about 24" wide (from the left side 3*l* to the right side 3*r*). The specifications given are of a size and shape suitable for providing comfort to a seated user's buttocks and thighs, though the same can be accomplished with somewhat different specifications, especially to take into account people whose size is different than fairly typical American adults. The cushion filling 3 extends far enough from front 3*f* to back 3*b* to support at least about ⅔ of the underside of a user's thighs. In another preferred embodiment, shown in FIG. 1J, the cushion has a slight incline, so that it is higher near the front 3*f* than it is in the back 3*b*. In this embodiment, the front 3*f* is about 6" high and the back 3*b* is about 4" high. Of course, the cushion filling 3 can be made to somewhat different specifications, and made of different materials including cotton, feathers, polyester fill, dacron fill, shredded foam, and other relatively soft materials either known or to be known in the industry.

Figure 1D:
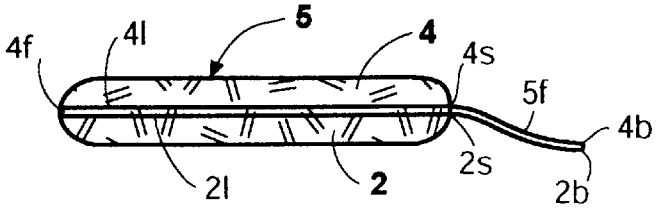
FIG. 1D is a side view of the seat cushion formed when the cushion filling of FIG. 1C is inserted into the upholstery fabric shown in FIG. 1B.

FIG. 1D is a side view of the seat cushion 5 formed when the foam cushion filling 3 of FIG. 1C is inserted into the upholstery fabric shown in FIG. 1B. To define terms, when the word "cushion" is used alone or with modifiers such as soft, resilient, foam and/or filling, it refers only to the soft resilient material which is used for filling as shown in FIG. 1C. The term, "seat cushion" refers to the upholstered product which is made of the "cushion" 3 covered with the upholstery fabric shown in FIG. 1B. The top fabric 4 and the bottom fabric 2 are shown to have generally taken on the form of the foam cushion 3 shown in FIG. 1C, and there is a flap 5*f* extending from where the cushion filling ends (near 2*s* and 4*s*) to the end of the top fabric 4*b* and the end of the bottom fabric 2*b*. The back 4*b* of the seat cushion 5 and the back 4*b* of the flap 5*f* are the same, since the flap 5*f* is a part of the seat cushion 5. The thickness of the seat cushion 5 is generally even from the front 4*f* to stitch line 4*s*, though it is rounded off at the very front and back of the cushion filling.

Figure 1E:
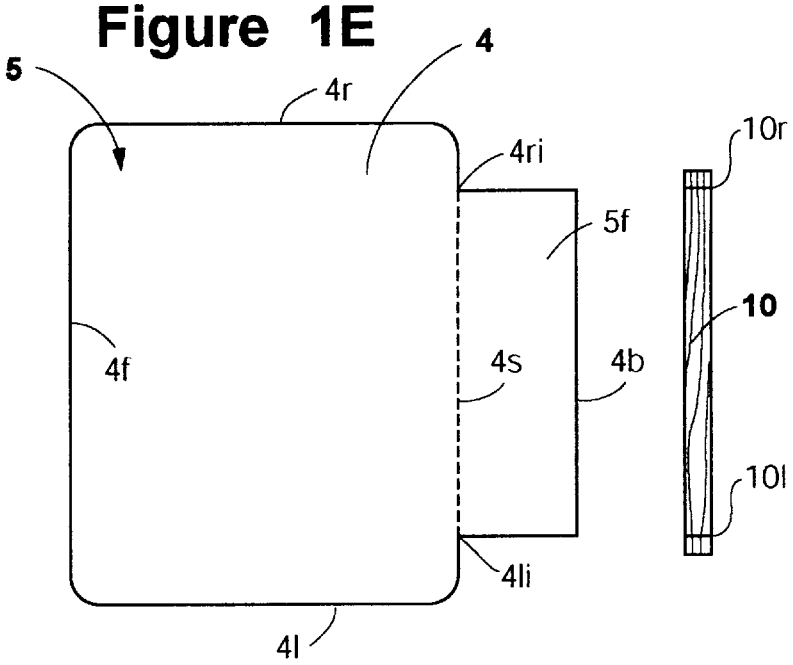
FIG. 1E is a top view of the embodiment shown in FIG. 1D shown with the stitch line used to sew the seat cushion closed.

FIG. 1E is a top view of the embodiment shown in FIG. 1D shown with the stitch line 4*s* used to sew the seat cushion 5 closed. There are at least two ways to sew the seat cushion 5 closed along the stitch line 4*s*. One way, is to compress the foam cushion filling 3 away from 4*s* and 4*b*, so that the fabric is loose enough to fit under the foot of an ordinary sewing machine. This can be done by compressing the cushion 3 by hand or with a jig made to compress the cushion. To compress by hand, the person sewing it would put one hand into the opening of the bag between 4*b* and 2*b* as shown in FIG. 1D and compress the cushion 3 toward the front 4*f* of the bag. After compressing the cushion 3, the compressed cushion is held in a compressed state with the sewer's other hand on top of the fabric 4. While this is held, the stitch line 4*s* is sewn as shown. This effectively closes the bag, and holds the foam cushion 3 in place. For a production setting, a jig might be preferred. A jig could consist of a top piece and a bottom piece of a flat rigid material (such as plate metal) each having a side to side measurement of about 2" greater than the side to side measurement of the cushion 3, and a front to back measurement of up to about the front to back measurement of the cushion 3. The seat cushion 5 would be put between the top and bottom piece of material, with the flap 5*f* between 4*s* and 4*b* hanging out. Then the plates would be drawn together with a clamping mechanism that could work somewhat like a vice. When the foam cushion 3 is compressed, the fabric should be loose enough to enable an ordinary sewing machine to close the bag along the stitch line 4*s*. It is also possible to use specialized sewing machines that are known in the industry, such as a post bed sewing machine or a cylinder bed sewing machine. Use of one of these machines could minimize the need to substantially compress the cushion 3 before sewing.

It should be noted that there are other ways of closing the seat cushion 5 along the stitch line 4*s* that do not involve sewing. Other possible methods include using an adhesive along the stitch line, grommets, laces, a zipper, snaps, buttons, or other methods of attaching two layers of an upholstery material together. Though these methods are technically not "stitching", they will be considered as such for the purposes of the claims.

It should also be noted that the term "stitch line" for the purposes of the claims refers to the line 4*s* on the upholstery material that would be followed for sewing the seat cushion 5 closed generally at the back of the cushion filling 3*b*. While the stitch line 4*s* in the presently preferred embodiments is sewn closed, a seat cushion 5 can be made without sewing the seat cushion 5 closed at the stitch line 4*s*. The advantages in sewing the seat cushion 5 closed at the stitch line 4*s*, are that the cushion filling is maintained in a stable position, and the stitching provides uniform pressure on the cushion filling 3—eliminating a bulge along the stitch line.

A feature of the present invention that might be noted when viewing this figure is that the back of the flap 4*b* does not need to be sewn shut or given a decorative finish to give the seat a finished look, as it will be generally hidden when it is secured to the lower cross member 10.

Figure 1F:
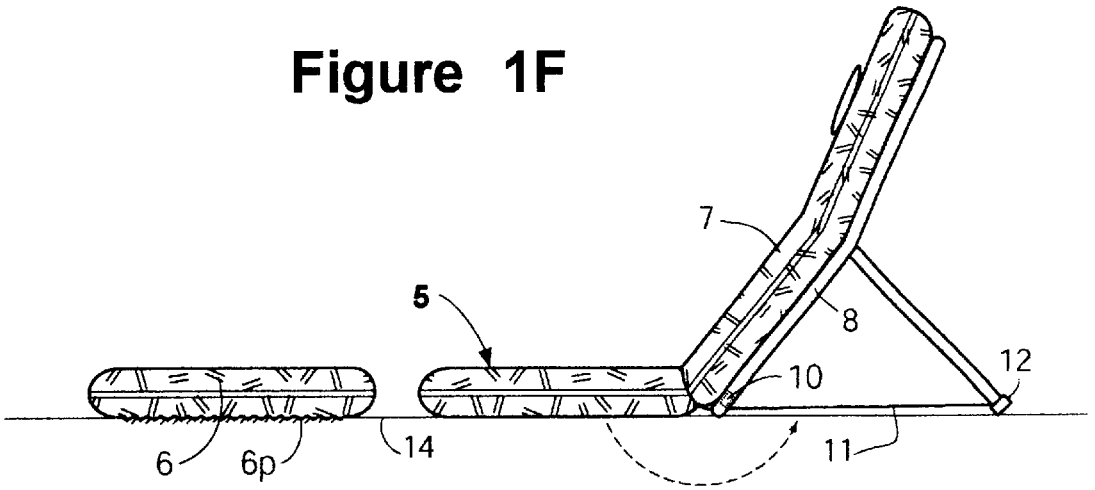
FIG. 1F is a side view of the embodiment shown in FIGS. 1D and 1E shown with the seat cushion attached to the frame of a legless leisure chair and also showing an ottoman.
Figure 4:
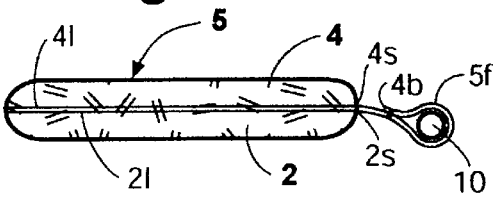
FIG. 4 is a side view of an embodiment similar to the one shown in FIG. 1D, but with the end of the attachment flap sewn into a tube for attachment to a leisure chair frame.

As shown in the drawing, the flap 5*f* is about 16–18" wide from the left side near 4*li* to the right side near 4*ri*, while the width of the seat cushion from the front 4*f* to the stitch line 4*s* is greater in width—about 20" to about 28". An advantage in having the flap 5*f* with a smaller width than the rest of the seat cushion is that the flap 5*f* will not be seen from the sides when the seat cushion 5 is attached to a leisure chair as shown in FIG. 1F. Note that the flap and the front lower cross member 10 have about the same width. The lower cross member 10 of a legless leisure chair is shown in the drawing from a top view with the cross member laying flat. The cross member 10 in a preferred embodiment is about 16–18" wide (not counting the tenons), ¾" thick and about 1½" high, and is made of wood with tenons extending beyond the ends. The width is measured from the left end 10*l* to the right end 10*r* of the cross member 10. Of course the cross member 10 can be made of other materials such as metal tubing as shown in FIG. 4, or of other appropriate materials.

FIG. 1F is a side view of the embodiment shown in FIGS. 1D and 1E shown with the seat cushion 5 attached to the frame 8 of the backrest and also showing an ottoman cushion 6. This drawing shows the relationship between the backrest cushion 7, the seat cushion 5 and the ottoman cushion 6. The drawing also shows how the legless leisure chair sits on a floor 14 making clear that the bottoms of the seat cushion 5 and ottoman cushion 6 are generally parallel with and in contact with the floor. In a preferred embodiment, the ottoman 6 is made of a foam cushion having an IFD of about 10 to 20 pounds, having a height of about 3"–4", a side to side width of about 20 inches, and a front to back length of about 16" to about 20". The ottoman 6 is then covered with an upholstery fabric similar to the one used to cover the seat cushion 5. The ottoman 6 is placed in front of the seat cushion 5 as shown to provide support for the lower legs of someone sifting on the legless leisure chair.

The ottoman 6 shown is suitable for enabling someone sitting in the chair to stretch out his or her legs so that the calves and heels are supported, and also the ottoman is designed to enable the occupant to bend his or her legs at the knee, and put the arches of the feet on the edge of the ottoman 6 nearest the seat cushion 5 for a change of position. A person sitting in the chair with knees bent and arches on the edge of the ottoman 6, is likely to exert pressure that would tend to push the ottoman 6 away from the seat cushion 5. To make the ottoman 6 resist this pressure, in preferred embodiments, the underside of the ottoman 6 is made of a slip resistant material so that when someone sitting in the chair exerts pressure on the ottoman 6 with the arches of his or her feet, the ottoman will not slide away. On carpeting, when the upholstery fabric is a velvet or another fabric having a pile, and the pile 6*p* direction is oriented away from the seat cushion 5 as shown, the underside becomes slip resistant. Other fabrics which do not slip easily on carpeted surfaces can also work. Some known to provide a friction means on carpet are fabrics or materials that are somewhat rough like some canvases, coarse, textured, or like felt. On hard surface floors, an underside of rubber might work. Though in some cases the same material used to upholster the top of the ottoman might be used to provide the slip resistant underside, if the top of the ottoman is made of a slippery surface such as leather or vinyl, another material would be used on the underside. It is also preferred that the ottoman filling not be made of a filling such as polystyrene pellets which are easily diplaced and especially lightweight. This is because an easily displaced filling is not as likely to provide a uniform pressure on the floor, and hence may be more likely to slip.

The seat cushion 5 and the ottoman 6 are of a generally similar shape and proportion, except that the seat cushion 5 has a flap. Though the ottoman 6 and seat cushion 5 can be exactly the same size and shape, in the presently preferred embodiments, the ottoman 6 is somewhat smaller, generally as described above. The ottomans of preferred embodiments have a height, a length, and a width of at least 70% of the height, length, and width respectively, of the filled portion of the seat cushions they complement.

It should be noted that the term "backrest frame" is the same as "occupant supporting member" referred to on my previous applications. Also, the backrest frame and cushion have a face and an underside. The face is simply the portion of the cushion or frame that an occupant leans against, and the underside is the side opposite the face. In the drawing, the number "7" and the head pillow on the backrest cushion 7 are near the face while the number "8" is near the underside.

Also shown in the drawing is a presently preferred position of the seat cushion 5 relative to the backrest cushion 7. In preferred embodiments, the backrest cushion 7 is between about 2½ inches and about 6 inches thick. In the present figure, the backrest cushion 7 is shown about 4 inches thick. It might be noted that the seat cushion 5 can be easily rotated under the frame 8 for shipping or storage. The rotation is shown by the dashed line with the arrow, and the chair is shown in the folded position in FIG. 1I. The present drawing also shows the counter supporting member 12 on the frame, and the chord 11 which keeps the frame in the right position.

Figure 1G:
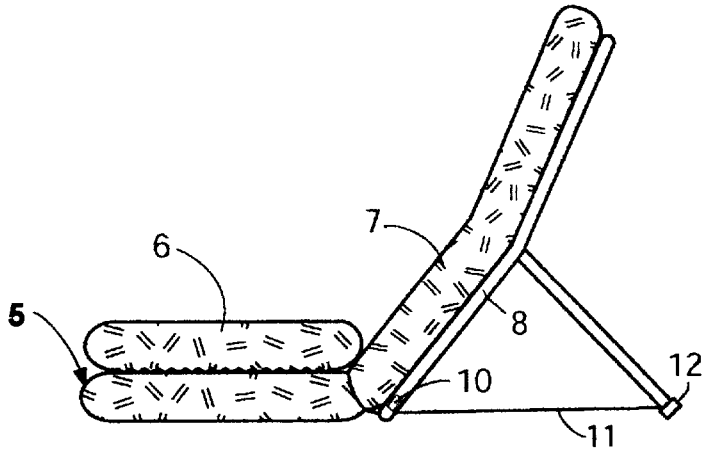
FIG. 1G is a side view of the embodiment shown in FIG. 1F, but with the ottoman placed above the seat cushion to make the chair more compact when not in use.

FIG. 1G is a side view of the embodiment shown in FIG. 1F, but with the ottoman cushion 6 placed above the seat cushion 5 to make the chair more compact when not in use. It is very convenient to simply put the ottoman 6 on top of the seat cushion as shown. Another advantage in storing the ottoman 6 on top of the seat cushion 5 is that the chair can look very presentable when it is in this compact form.

Figure 1H:
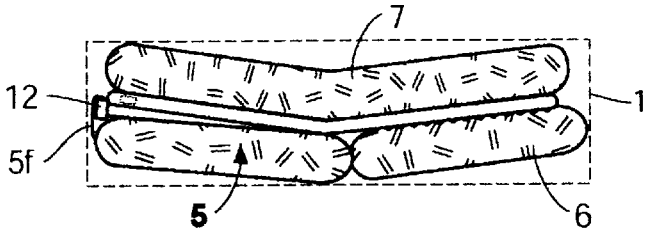
FIG. 1H is a side view of the embodiments shown in FIGS. 1F–1G, but shown with the seat cushion and the ottoman positioned for transport in a box.

FIG. 1H is a side view of the embodiments shown in FIGS. 1F–1G, but shown with the seat cushion 5 and the ottoman 6 positioned for transport in a box 1 or other very compact storage. In the drawing, the dashed line represents the walls of the box 1. It should be noted that the relatively long flap is of particular value when the seat cushion 5 is flipped to the back of this legless leisure chair, because the flap needs to be of sufficient length to enable the seat cushion to wrap around the base of the countersupporting member 12.

Figure 1I:
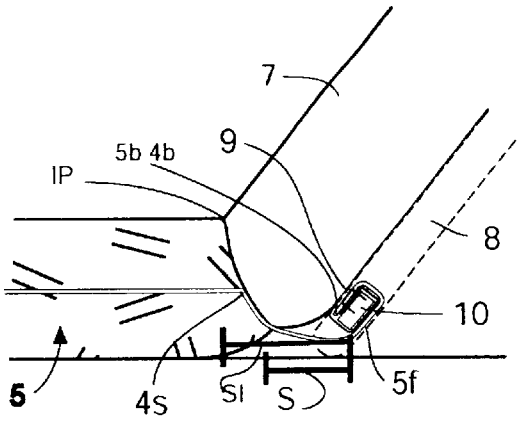
FIG. 1I is a side view of the embodiment shown in FIGS. 1D–1H showing the way the seat cushion is attached to the cross piece of the backrest frame.

FIG. 1I is a side view of the embodiment shown in FIGS. 1D–1H showing the way the seat cushion 5 is attached to the front lower cross member 10 of the backrest frame 8. The upholstered backrest cushion 7 is made in accordance with U.S. Pat. No. 5,655,812 entitled UPHOLSTERY SYSTEM FOR CHAIRS. As shown in the drawing, the flap 5*f* on the seat cushion 5 from 4*s* to 4*b* is partially wrapped around the cross member 10, and secured with staples 9 or another suitable mechanical fastener such as all purpose screws with countersunk washers. It should be noted that fabric from the upholstery system on the backrest cushion 7, wraps around the cross member 10 before the flap 5*f* from the seat cushion 5 wraps around the cross member 10. The cross member 10 is attached to the backrest frame 8 with mortise and tenon construction. The length of the flap 5*f* between the bottom of the cross member 10 and the stitch line 4*s* is called the span length S, and in preferred embodiments is between about 1 1/12" and about 3". The bottom of the cross member 10 refers to the lowest point on the lower cross member 10 when the backrest 8 is in the usable position as shown. The horizontal distance between the bottom of the lower cross member 10 and the intersection point IP, as described in FIG. 1K, is shown as SI which stands for span to intersection point. The span to intersection point SI on preferred embodiments is between about 2" and about 6".

Figure 1J:
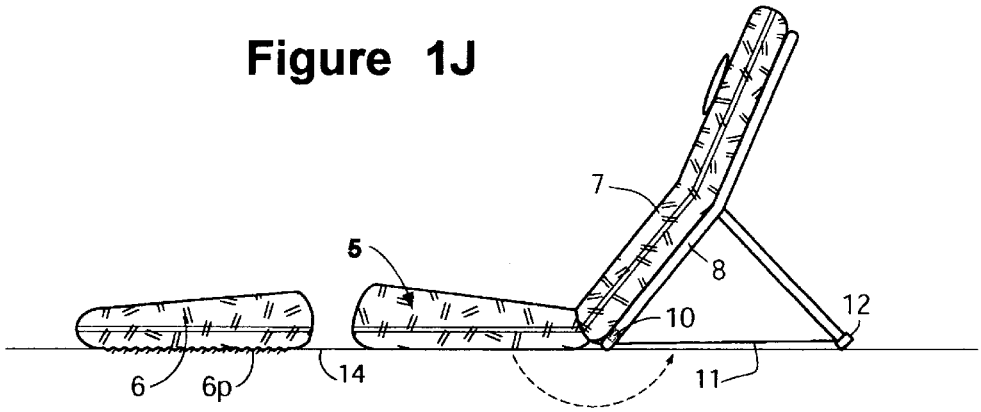
FIG. 1J is a side view of an embodiment of the present invention similar to the one shown in FIG. 1F, but with the seat cushion having a slight incline as it goes away from the backrest cushion and with the ottoman having a slight decline as it goes away from the seat cushion.
Figure 1K:
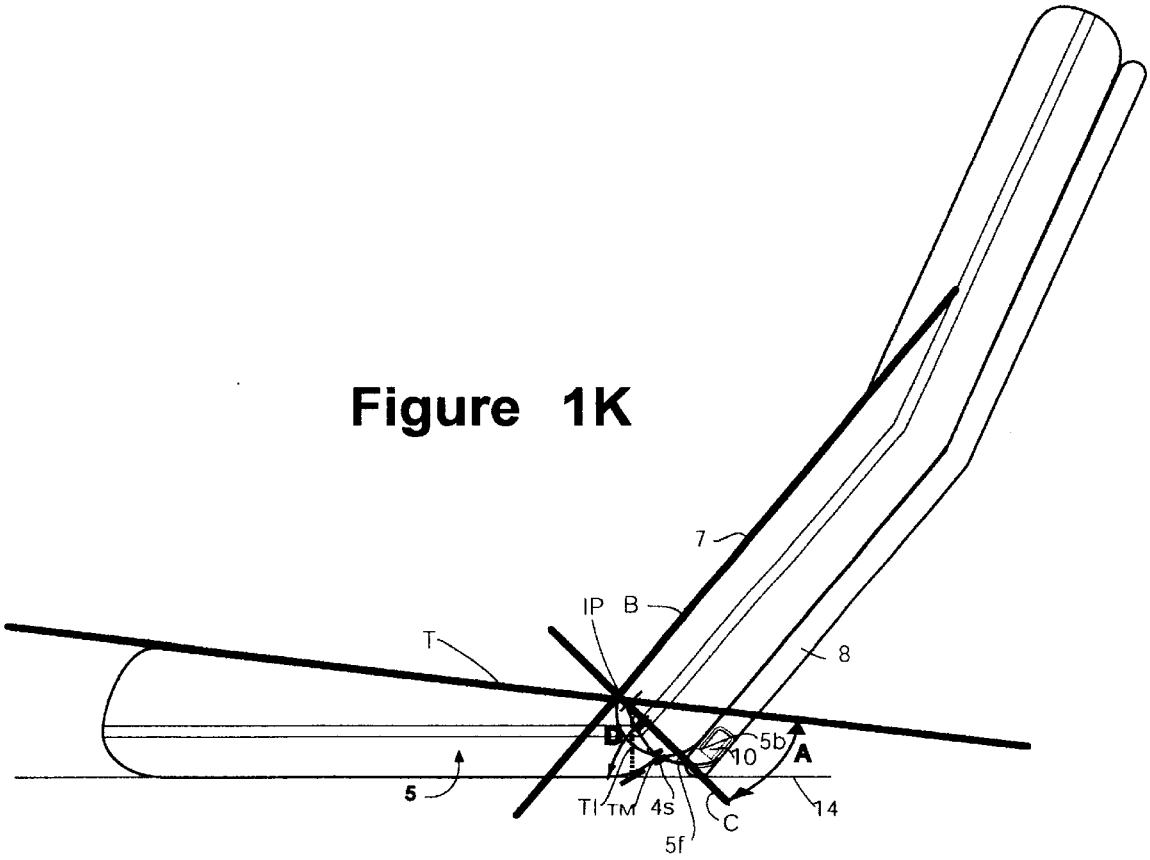
FIG. 1K is a side view of the embodiment shown in FIG. 1J, showing the relative planes of the seat and backrest.

FIG. 1J is a side view of an embodiment of the present invention similar to the one shown in FIG. 1F, but with the seat cushion 5 having a slight incline as it goes away from the backrest cushion 7 and with the ottoman 6 having a slight decline as it goes away from the seat cushion 5. In a preferred embodiment, the seat cushion 5 is about 4 inches near the backrest cushion 7 and about 6 inches at the front. The ottoman 6 is about 5 inches at the part nearest the seat cushion 5, and about 3 inches at the part furthest from the seat cushion 5. Putting a slight slope on the seat cushion 5 or the ottoman can enhance the comfort of the seat system. It is also quite appropriate to use the seat cushion 5 shown in FIG. 1J with the ottoman 6 shown in FIG. 1F, or to use the seat cushion 5 shown in FIG. 1F with the ottoman 6 shown in FIG. 1J. The seat systems shown in FIGS. 1F and 1J as well as the hybrids formed by mixing the inclined seat or ottoman with a flat seat or ottoman each have some advantages. The inclined seat 5 of FIG. 1J provides comfort, but at the same time makes it a bit more difficult for a person to sit up for a change of position. As with most things, there are tradeoffs to consider.

FIG. 1K is a side view of the embodiment shown in FIG. 1J, showing the relative planes of the seat cushion 5 and the backrest cushion 7. In the drawing, T is the predominant plane of the top of the seat cushion 5, B is the predominant plane of the lower portion of the face of the backrest cushion, IP is the point where T and B intersect, C is the plane between the intersection point IP and the bottom of the lower cross member 10, A is the angle between the planes C and T, D is the angle between the plane C and the floor 14, TI is the thickness of the seat cushion near the intersection point, and TM is the thickness of the seat cushion at a midpoint between the intersection point IP and the lower cross member 10. The term predominant plane T refers to the plane which is most common or conspicuous from the front 4*f* of the seat cushion 5 to the intersection point IP on the seat cushion 5. The vertical distance between the predominant plane T and the floor 14 defines the predominant thickness trend of the resilient cushion filling from the front of the seat cushion 5 to the intersection point IP. The predominant plane B refers to the plane which is most common or conspicuous on the lower portion of backrest cushion 7. The lower portion of the backrest cushion 7 refers to the lower 40% of the backrest cushion, below the obtuse angle generally in the middle of the backrest cushion. The phrase "near the intersection point IP" when referring to the thickness TI of the seat cushion 5 refers to the point nearest the intersection point IP at which the thickness TI of the seat cushion 5 is within about 10% of the height of the predominant plane T when measured perpendicularly from the floor 14. In preferred embodiments, the thickness TI of the seat cushion 5 near the intersection point TI is between about 2½" and about 6". Near the midpoint between the intersection point IP and the lower cross member 10, the thickness TM of the seat cushion has declined dramatically as compared to the thickness TI near the intersection point IP. As seen in this drawing, as the seat cushion 5 goes under the backrest cushion 7, it tapers rapidly, and near the midpoint the seat cushion 5 has a thickness only about as thick as the flap 5*f*. The rapid taper under the backrest cushion 7 is significantly different than the predominant plane T of the seat cushion 5. As shown, the predominant plane T is at a very different slope than the plane C between the intersection point IP and the bottom of the lower cross member 10.

There are a number of advantages to having the seat cushion 5 turn down relatively sharply near the intersection point IP. First, the seat cushion 5 aligns with the backrest cushion 7 in a way that is generally attractive and comfortable for sitting. If the seat cushion 5 continued following the predominant plane all the way to the backrest frame 8, the backrest cushion 7 would be displaced. Displacing the backrest cushion 7 would result in the bottom of the backrest cushion 7 being higher, which has a number of ramifications, especially if used with an upholstery system like the one described in my U.S. Pat. No. 5,655,812. Second, the seat cushion 5 can be easily pivoted to the rear as shown in FIGS. 1F and 1H. Third, the seat cushion 5 can be sewn relatively easily because there are a few inches of upholstery material between the stitch line 4*s* and the back 5*b* of the seat cushion 5, as seen in FIGS. 1D–1E.

In preferred embodiments like shown in FIG. 1K, angle A is between about 20 degrees and about 50 degrees, and angle D is between about 60 degrees and about 30 degrees.

Figure 1L:
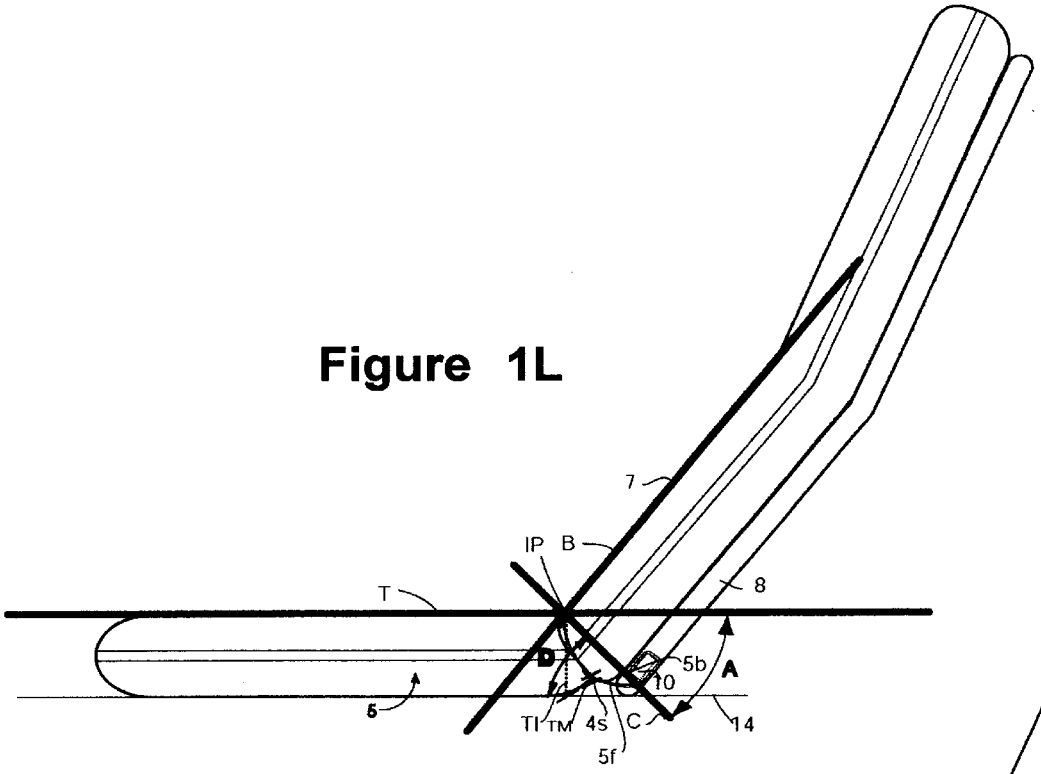
FIG. 1L is aside view of the embodiment shown in FIG. 1F showing the relative planes of the seat and backrest.

FIG. 1L is a side view of the embodiment shown in FIG. 1F showing relative the planes of the seat and backrest. The references to letters and numbers are the same as described in FIG. 1K. Since the seat cushion 5 in this cushion is generally level on top, the predominant plane T is generally level, which results in angle A being slightly greater than the angle A in FIG. 1K. Angle D is generally unchanged. Since angle A is slightly greater in the present figure, the relative degree of drop off near the intersection point IP is slightly greater. In preferred embodiments like the one shown in FIG. 1L, angle A is between about 30 degrees and about 60 degrees, and angle D is between about 60 degrees and about 30 degrees, and the thickness TI of the seat cushion 5 near the intersection point TI is between about 2½" and about 6". Near the midpoint between the intersection point IP and the lower cross member 10, the thickness TM of the seat cushion has declined dramatically as compared to the thickness TI near the intersection point IP. As seen in this drawing, as the seat cushion 5 goes under the backrest cushion 7, it tapers rapidly, and near the midpoint the seat cushion 5 has a thickness TM only about as thick as the flap 5*f*.

Figure 1M:
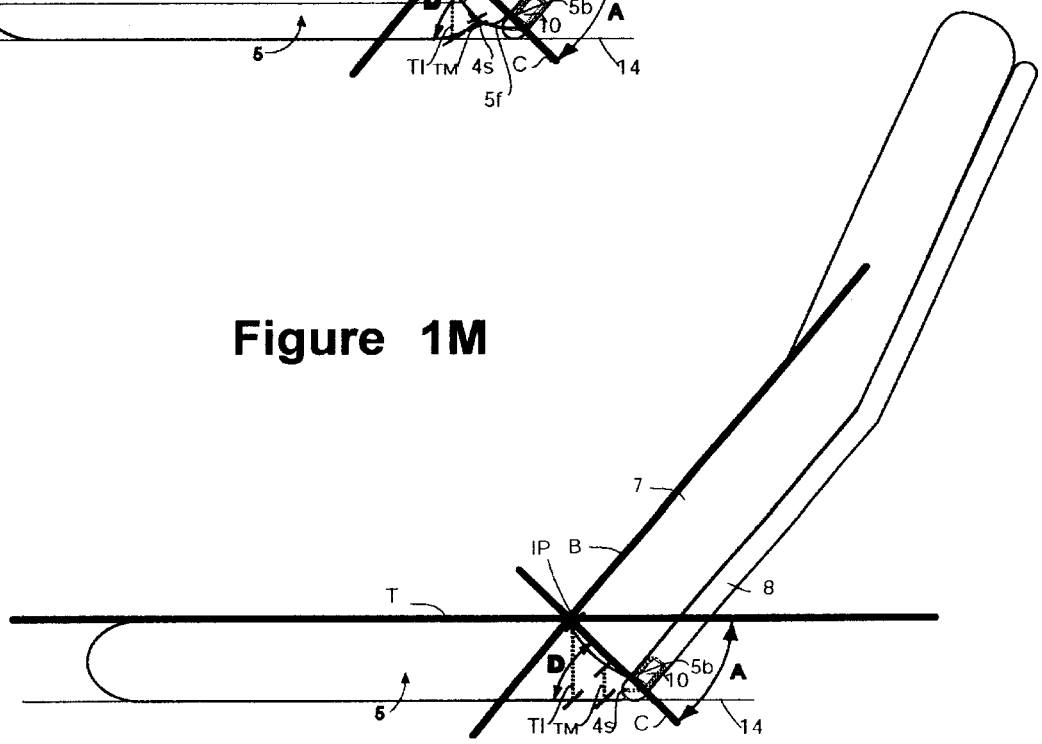
FIG. 1M is a side view of the embodiment shown in FIG. 5B attached to a leisure chair backrest, and showing relative planes of the seat and backrest.
Figure 5A:
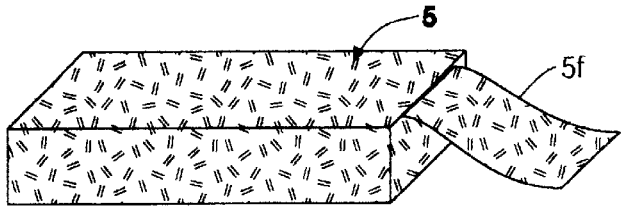
FIG. 5A is an isometric view of an embodiment of the present invention made with a boxed bordered cushion style.
Figure 5B:
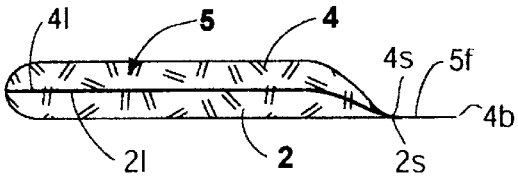
FIG. 5B is a side view of an embodiment of the present invention where the cushion filling is tapered downward toward the stitch line.

FIG. 1M is a side view of the embodiment shown in FIG. 5B attached to a leisure chair backrest, and showing relative planes of the seat and backrest. The references to letters and numbers are the same as described in FIG. 1K. In this drawing, the thickness of the seat cushion 5 begins to drop off substantially beginning at the intersection point IP, and continues to decline at a generally steady rate almost up to the lower cross member 10. The thickness of the seat cushion TM at a midpoint is about half the thickness of the seat cushion TI near the intersection point. In preferred embodiments like the one shown in FIG. 1M, angle A is between about 30 degrees and about 60 degrees, and angle D is between about 60 degrees and about 30 degrees, and the thickness TI of the seat cushion 5 near the intersection point TI is between about 2½" and about 6". It should be noted that it is quite possible to make a seat cushion 5 with the kind of drop off shown in the present figure, but with a slight incline in the cushion filling like shown in FIGS. 1J and 1K.

Figure 2A:
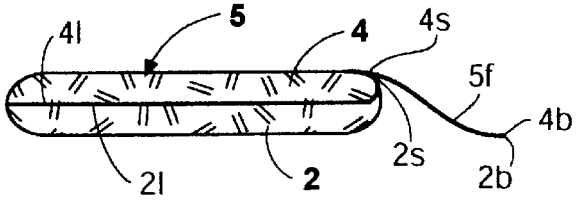
FIG. 2A is a side view of an embodiment of the present invention similar to the one shown in FIG. 1D, but with the attachment flap extending from the top of the seat cushion.

FIG. 2A is a side view of an embodiment of the present invention similar to the one shown in FIG. 1D, but with the attachment flap 5*f* extending from the top of the seat cushion 5. When the flap 5*f* is near the top of the seat cushion 5, the seat cushion 5 can be made to fold upward when on a legless leisure chair such as the one shown in FIG. 1F. This can have benefits both for packing the chair compactly and also so that the chair can take up minimum floor space when not in use. Another advantage of putting the flap on the top is that it could be easier to sew the upholstery bag closed (as described under FIG. 1E) on an ordinary sewing machine.

Figure 2B:
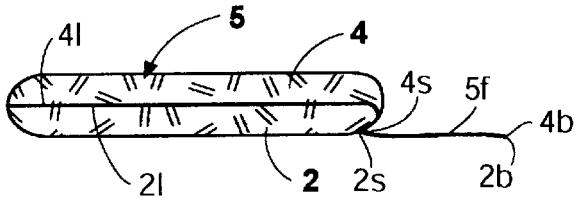
FIG. 2B is a side view of an embodiment of the present invention similar to the one shown in FIG. 1D, but with the attachment flap extending from the bottom of the seat cushion.

FIG. 2B is a side view of an embodiment of the present invention similar to the one shown in FIG. 1D, but with the attachment flap 5*f* extending from the bottom of the seat cushion 5. This is made basically the same way as the seat cushion 5 described under FIG. 2A, but it is turned upside down before attaching it to a legless leisure chair. Obviously, if batting is used on the foam cushion 3 (as described in FIG. 1C) inside the seat cushion, it will be necessary to make sure that the foam cushion 3 is inserted in so that the intended top 3*t* of the foam cushion ends up on the top of the seat cushion 5 when it is to be attached to the legless leisure chair.

Figure 2C:
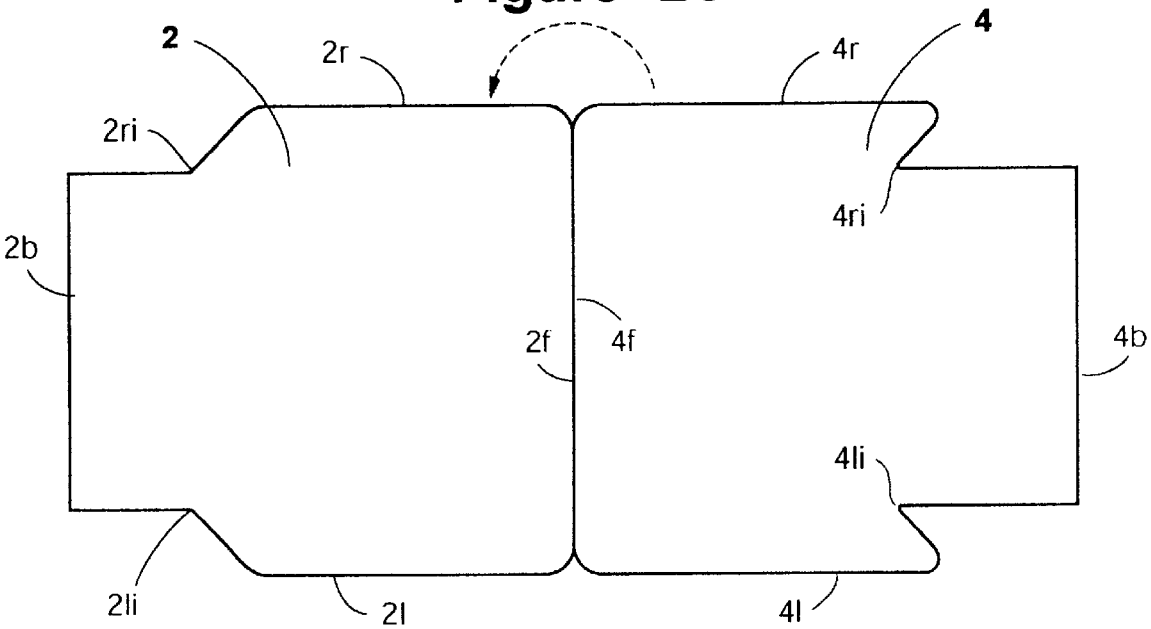
FIG. 2C is a top view of the upholstery fabric used to make the seat cushion shown in FIG. 2A.

FIG. 2C is a top view of the upholstery fabric 2 and 4 used to make the seat cushion 5 shown in FIG. 2A. The seat cushion in FIG. 2A is made in basically the same manner as described in FIGS. 1A–1H, except that the pattern of the fabric around the indentations 2*ri*, 2*li*, 4*ri*, and 4*li* is cut as shown in the present drawing to make the flap 5 end up on the top as shown in FIG. 2A.

Figure 3:
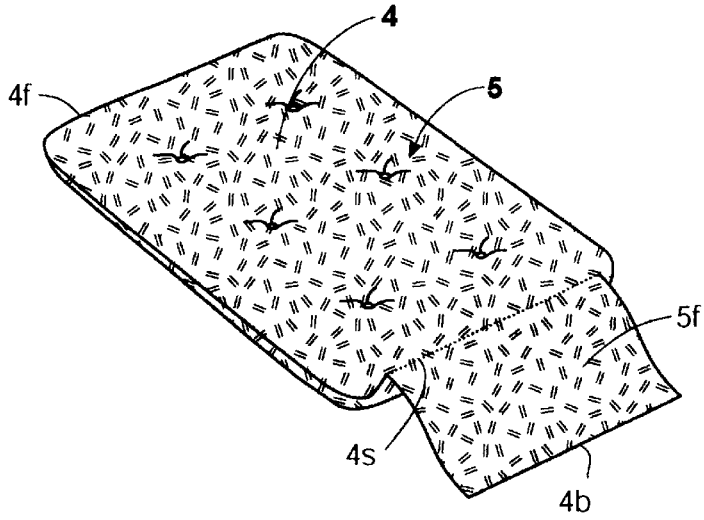
FIG. 3 is an isometric view of an embodiment of the present invention which is extended to provide a legrest for a user's lower legs.

FIG. 3 is an isometric view of an embodiment of the present invention which is extended to provide a legrest for a user's buttocks, thighs, calves, and heels. This can be made in basically the same manner as described for FIGS. 1A–1H and FIGS. 2A–2C, except that the cushion filling and fabric are extended. In a preferred embodiment, the length of the seat cushion 5 is about 42", though for people of different heights, the length could range from about 30" to about 45". This seat cushion 5 is presently preferred on outdoor legless leisure chairs, where it would probably be filled with polyester fill, instead of foam. The seat cushion 5 can be made to fold in the middle for easier storage or transport. The method of making the cushion foldable can be like the methods commonly used in the industry related to outdoor furniture cushions. The seat cushion 5 as shown could be used for interior use, but presently the arrangement shown in FIG. 1F is preferred for most interior applications.

FIG. 4 is a side view of an embodiment similar to the one shown in FIG. 1D, but with the end of the attachment flap 5*f* sewn into a tube 5*t* for attachment to a leisure chair frame. This could be particularly suited for frames that are made of metal, but could be used for other frames as well. An attachment flap 5*f* with a tube 5*t* as shown could be attached with mechanical fasteners such as staples or screws, or could simply be slipped over the front lower cross member 10 of the chair. This type of attachment means would be especially well suited to legless leisure chairs where there is a bottom cross member 10 which is not greatly relied upon to hold the support sheet of the backrest in place, such as where the support sheet is attached primarily to the sides of the frame. In such an example, it is feasible to have the tube sewn FIG. 5A is an isometric view of an embodiment of the present invention made with a boxed bordered cushion style. This provides one example of how the seat cushion 5 can be sewn to give a different look. The concept of the seat cushion 5 can be made with other upholstery styles used in the industry, but probably none is as simple to make as the one shown in FIGS. 1A–2B.

FIG. 5B is a side view of an embodiment of the present invention where the cushion filling is tapered downward toward the stitch line. This embodiment enables more of the cushion filling to be under the backrest cushion. As shown, the top of the seat cushion 5 begins to taper near the intersection point IP shown in FIG. 1M.

SEAT SYSTEMS DESCRIBED PREVIOUSLY

NOTE: Pertinent parts of U.S. Pat. No. 5,836,653 cited under BACKGROUND—CROSS REFERENCE TO RELATED APPLICATIONS are reproduced under FIGS. 6–8. FIGS. 6A, 6B, 6C, 7A, 7B and 8 in the present application are FIGS. 1A, 1B, 1D, 2E, 2F, and 5 respectively in the cited application. The only change to wording is under FIG. 7A, where "previous figures" has replaced a reference to figures not reproduced into the present application.

Figure 6A:
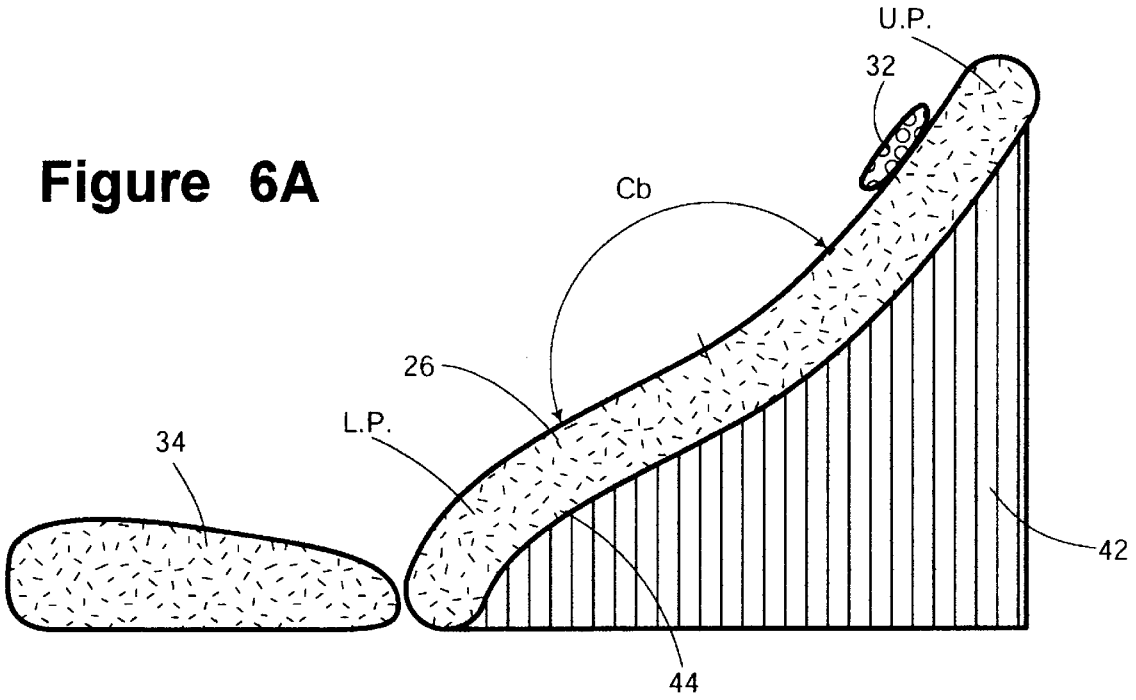
FIGS. 6–8 show various views from seat systems described in a referenced application.

FIG. 6A is a side view of an embodiment of the present invention . . . Additionally a seat cushion 34 is shown for supporting the buttocks and at least part of an occupant's legs. In a preferred embodiment, the seat cushion 34 is filled with a firmer material than the top cushion 26. The reason for this is that in addition to preventing the user from sliding down, a lot of the user's weight is concentrated on the seat cushion 34. The seat cushion 34 can be filled with loose fill such as feathers, shredded polyurethane foam, dacron, etc., or could be a relatively firm polyurethane foam material, preferably with an LID (Indentation Load Deflection on 4" at 25%) of about 40 pounds. If a loose fill material is used, it can be packed much more tightly than for the head pillow 32 mentioned above. The seat cushion 34 can be made with a material about as firm as the top cushion 26, but if it is, it probably should be thicker. It is also possible to make the seat cushion 34 in layers, with the bottom layer(s) of firmer material and the top layer(s) of a softer material. In general, the seat cushion 34 should be more supportive than the top cushion 26 (an exception might be if the top cushion 26 is made of an extra firm material with an LID greater than 40 pounds or if it was made more than 5" thick).

The foundation 42, top cushion 26, seat cushion 34, and head pillow 32 can be made out of blocks of polyurethane foam, and cut to size and shape with band saws or other cutting tools used in the art related to foam fabricating.

Figure 6B:
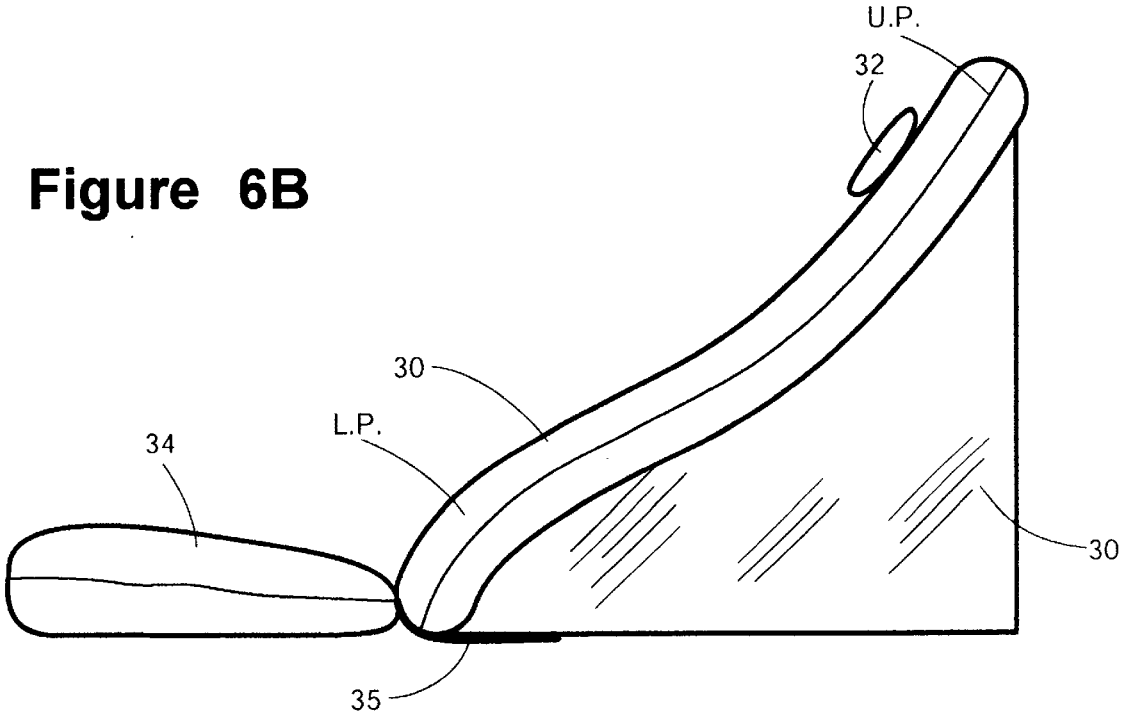

FIG. 6B is a side view of the embodiment shown in FIG. 6A, but shown with upholstery 30. Note that the seat cushion 34 is attached to the foundation 42 or the upholstery 30 on the foundation with an upholstery attachment means 35. Unlike the head pillow straps mentioned above, this upholstery attachment means 35 or a similar means of securing the seat cushion 34 to the foundation 42 are essential to the proper working of the of this embodiment. The reason is that when a person is sitting on the leisure chair, there is a natural tendency to slide down caused by gravity. The seat cushion 34 is designed to prevent the user from sliding down, and needs to be secured so that the user won't slide down and move the seat cushion 34 while he or she slides down. It is not necessary that the seat cushion 34 be secured directly to the foundation 42, because if it is secured to the upholstery 30 or something else which is secured to the foundation 42, it will be indirectly secured to the foundation 42. In a preferred embodiment, the upholstery attachment means 35 could be upholstery material 30 from both the seat cushion 34 as well as the top cushion 26 joined together. I would compare this to the way the top of a typical bag of potato chips is sealed—with material from the front and back of the packaging being joined together and extending beyond the fillable portion of the package leaving a flap. In a similar manner, the seat cushion 34 could be put into upholstery material 30 that has been sewn together somewhat like a pillowcase or an open bag. After filling the upholstery 30 with the seat cushion 34, the open portion could be stitched closed, but in a manner that leaves the flap shown as the attachment means 35. This flap could then be attached to the foundation 42 or to upholstery 30 under the foundation with velcro, stitching, or possibly mechanical fasteners. The same type of technique could be used to close the bottom of the upholstery 30 on the top cushion 26—though it is not necessary that both the seat cushion 34 and top cushion 26 be secured together in this manner. Other methods that would be suitable for attaching the seat cushion 34 to the foundation 42 or upholstery 30 such as straps etc. are known in the art related to upholstery.

Figure 6C:
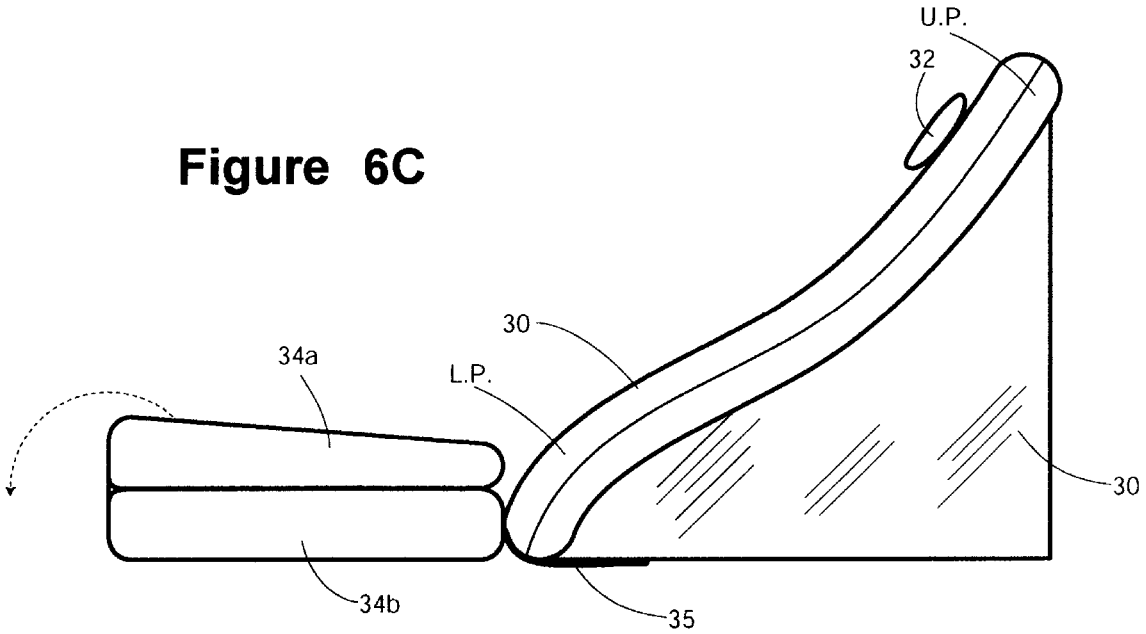

FIG. 6C is a side view of the embodiment shown in FIGS. 6A and 6B, but shown with an alternative seat cushion system. In the drawing, the seat cushion system is shown made with two parts,—a buttocks and thigh portion 34*b* and a calf and foot portion 34*a*. Note: For clarity in the description of this drawing and all other drawings in this application, the front of the chair is shown on the left, and the rear of the chair is shown on the right. The lower cushion 34*b* is made from a generally rectangular flexible foam cushion approximately 4" high, 24" from side to side, and about 18" to 20" from front to back. The upper cushion 34*a* is made of a cushion generally similar in dimensions to the lower cushion, except that it slopes down from what is shown in the drawing as left to right. These cushions 34*a* and 34*b* can be pivotally attached like a hinge at what is shown as the front of the seat system when they are stacked. Also shown near the front is an arrow showing how the top seat cushion 34*a* can pivot if desired. The advantage of this seat system is that it enables a floor chair to be similar to a lounge in terms of completely supporting the user's legs, but at the same time it can be both stored and used in the folded position as shown. The seat system can also be made to be unfolded with the bottom cushion folding forward or being rotated in a clockwise direction as opposed to the counter-clockwise arrow shown, while the top cushion stays in position—except for moving down. Of course to do this, the top cushion 34*a* would have to be attached to the attachment means 35. A seat system similar to the one shown in FIG. 6C is shown and described under FIGS. 7A and 7B which can be consulted to aid in understanding this type of seat cushion system. And of course, the seat system could be made out of one piece instead of the two 34*a* and 34*b* as shown. In this case, the seat cushion would always be in what for the system shown would be the open or unfolded position, and for storage, could simply be folded over pitched face of the foundation and top cushion. And for different preferences, the cushions could be reversed, with the buttocks and thigh cushion being sloped while the calf and foot cushion is generally rectangular.

Figure 7A:
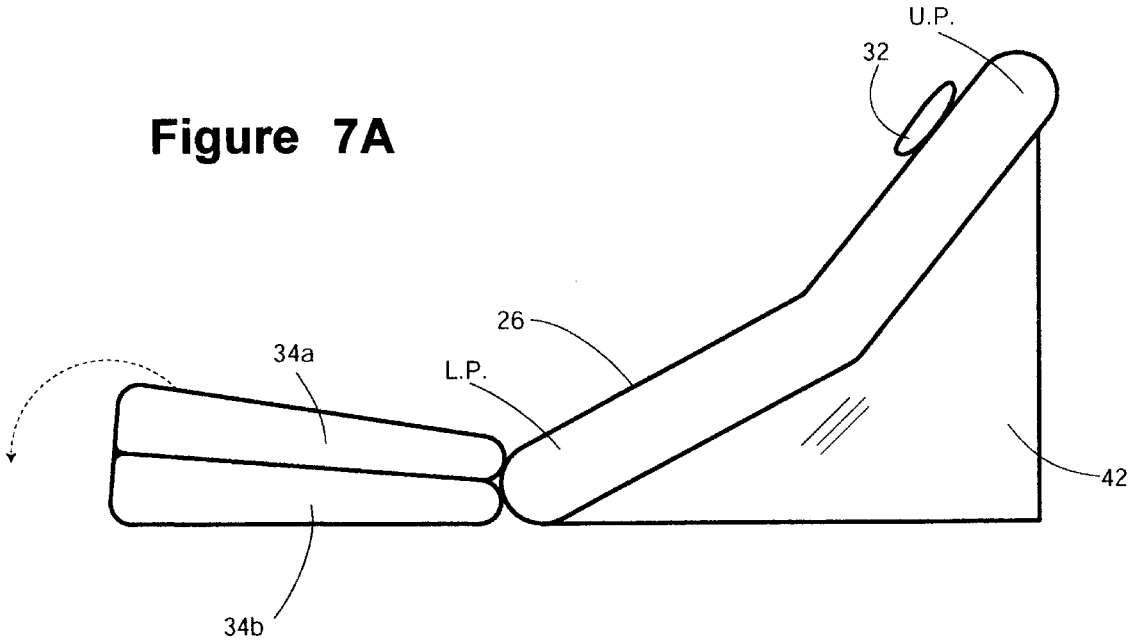

FIG. 7A is a side view of the embodiment shown in previous figures, but with an alternative seat system.

Figure 7B:
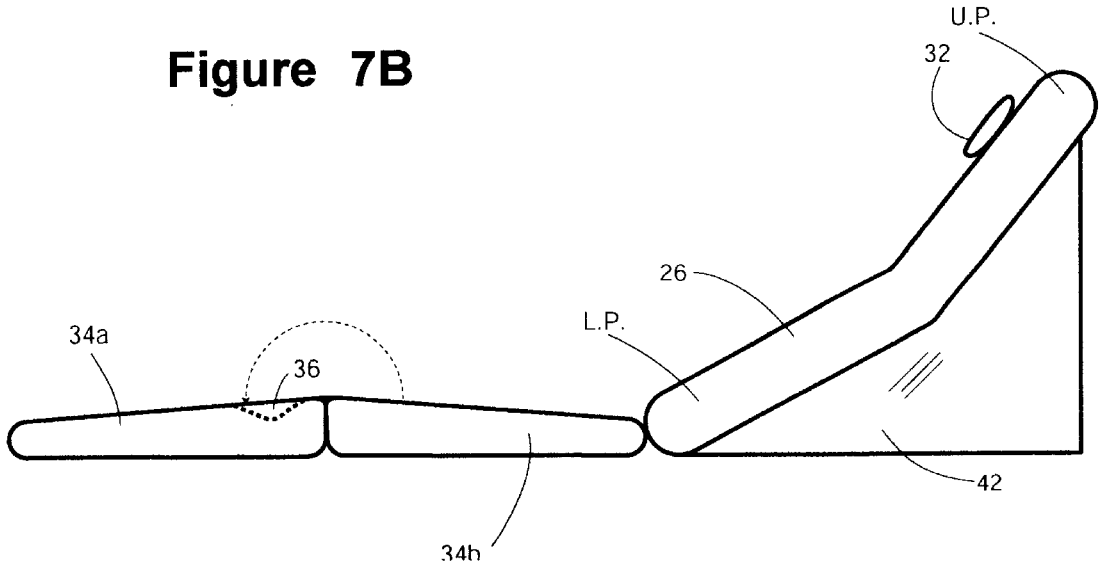

FIG. 7B is a side view of the embodiment shown in FIG. 7A, but with the alternative seat system in the extended position.

Note: Though this seating system is shown in two pieces 34*a* and 34*b*, it can certainly also be made of one piece that is not foldable. Note that an optional depression 36 is shown in the calf portion of the seat and legrest cushion 34 to serve as a foot support.

Figure 8:
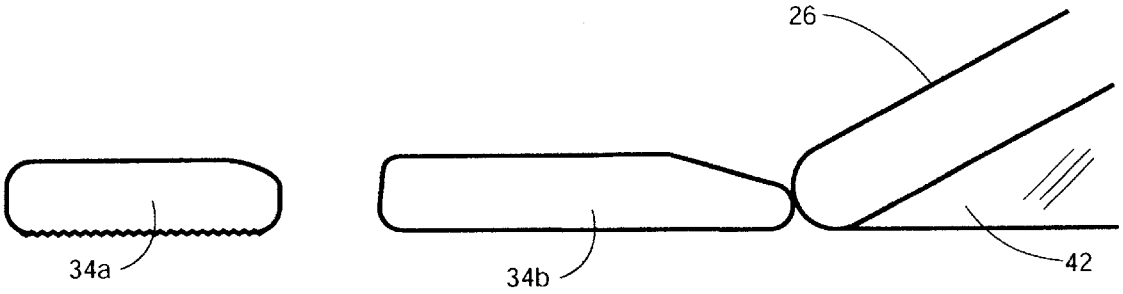

FIG. 8 is an alternative seat cushion 34*b* and an alternative legrest system 34*a* that could be used on the embodiments shown in FIGS. 6 and 7, as well as most of the legless leisure chairs described in my other patent applications. In the drawing, part of the seat cushion 34*b* is placed under the main backrest cushion 26 as shown. The seat cushion 34*b* could be made by putting a suitably sized and shaped cushion into an upholstery "bag" generally similar in construction to the way a pillowcase is made, but the upholstery bag would have about 6" of material extending at the open end beyond the cushion, for attaching to the foundation or frame of a legless leisure chair. This type of construction could be simpler than attaching straps, as well as somewhat more secure. The legrest portion 34*a* would be made of a cushion material upholstered, and having a generally flat top and bottom, having about the same width (side to side measurement) as the seat cushion 34*b*, a front to back measurement of about 10" to 18", and a height generally similar to the height of the seat cushion 34*b*. The top of the legrest cushion 34*a* could be pitched somewhat from front to back. The edge facing the main cushion 26 (which would be the back edge) can be shaped to accommodate the arches an occupant's feet while the top is shaped to accommodate the occupant's calves. The bottom of the upholstered legrest cushion 34*a* should be made in a manner that would prevent it from moving away from the main backrest cushion 26. This can be accomplished in a number of ways, in the case of a velvet material, the pile can be made to run in the direction that would make it catch on a carpet and keep it from moving away from the backrest cushion 26. Other solutions would include using material having a number of prongs on it such as the scratchy side of velcro type material. For use of a hard surface floor, a rubber or other non skid type material would be suitable, and also, a number of suction cups could be used. This type of seat and legrest system has the advantage of being adjustable, simple to manufacture, and makes it very convenient to make the chair compact when not in use by just putting the legrest portion 34*a* on the seat cushion 34*b*. While in a preferred embodiment, the seat cushion 34*b* is not in any way attached to the legrest cushion 34*a*, it certainly could be if desired with straps, strings or a similar attachment means.

CONCLUSIONS, RAMIFICATIONS, AND SCOPE OF INVENTION

Thus the reader will see that the seat systems for leisure chairs of this invention are economical, attractive, and useful. The seat system is very comfortable for reclining against the backrest of a legless leisure chair, and is also well suited for sitting up straight in a cross legged position without the use of the backrest. Additionally, the seat system provides a convenient way of making a legless leisure chair convenient to store or transport. The seat systems described can be sewn to or otherwise attached to the upholstery invention previously cited.

Although my above description contains many specificities, these should not be construed as limiting the scope of the invention, but merely as providing illustrations of the presently preferred embodiments of this invention. Many other variations are possible. This invention can be made a number of ways, with a wide variety of materials, and the principles of this invention can be applied to a number of other uses. Buttons or other upholstery accessories can be used as appropriate to make the seat system more effective. It is also possible to make this invention for multiple user's, simply by increasing the side to side width of the seat cushion and ottoman to make it wide enough for more than one occupant.

It is known in the industry that people have different preferences when it comes to comfort. While the descriptions of firmness, shapes, and sizes described in this application are specific, some people would prefer variations. Guidelines for making chairs such as those described herein for various groups of people and their preferences are available in the industry through such resources as Human-Scale and ANSI standards.

Other methods, materials, and techniques that can be applied to making seat cushions of this invention are known or will be known in the industry relating to this invention. Design, methods of construction, details and methods of manufacture are interchangeable between embodiments. Accordingly, the scope of the invention should be determined not by the embodiments illustrated, described, and measurements, but by the appended claims and their legal equivalents.

I claim:

1. An upholstered seat system which is attached to a legless leisure chair comprising:

a) a resilient cushion filling for a seat cushion having a top, a bottom, a front, a back, a left side, and a right side, further having a size and shape suitable for providing comfort to a seated user's buttocks and thighs;

b) an upholstery cover made of an upholstery material having a top, a bottom, a front, a back, a left side, a right side and a stitch line, said upholstery cover having an inside and an outside, said upholstery cover further having a cavity between the top, the bottom, the front, the stitch line, the left side, and the right side, said cavity having a size and a shape similar to the resilient cushion filling, wherein the upholstery material comprising the top of the cover extends from the front to at least 2" beyond the stitch line, and wherein the upholstery material comprising the bottom of the upholstery cover extends from the front to at least 2" beyond the stitch line; and c) a lower front cross member on said legless leisure chair, said lower front cross member having a top and a bottom, said legless leisure chair having a backrest frame or occupant supporting member to which said lower front cross member is attached, wherein the resilient cushion filling is in the cavity of the upholstery cover such that the resilient cushion filling is covered by the upholstery cover with the top, the bottom, the front, the back, the left side, and the right side of the resilient cushion filling generally contacting the top, the bottom, the front, the stitch line, the left side, and the right side respectively of the inside of the upholstery cover, and wherein a flap is formed by the upholstery material on said upholstery cover which extends from the stitch line to the back of the seat cushion; wherein said resilient cushion filling and said upholstery cover as described make a seat cushion with a flap, wherein the flap is secured to the lower front cross member of the legless leisure chair with an attachment means, and wherein the outside of the bottom of the upholstery cover is substantially on a floor when the legless leisure chair is positioned for use.

2. The seat cushion of claim 1 wherein the seat cushion has a front width determined by the distance from the left side to the right side between the front and the stitch line, a back width determined by the distance from the left side to the right side between the stitch line and the back, and wherein the front width is at least 2" greater than the back width.

3. The seat cushion of claim 2 wherein the lower front cross member of the legless leisure chair has a left end and a right end, and wherein the distance between the left end and the right end is approximately the same as the back width of the seat cushion.

4. The seat system of claim 1 further including an ottoman cushion comprising a cushion filling covered with upholstery fabric in front of the seat cushion, said ottoman cushion having a top and a bottom, wherein the ottoman is detached from the seat cushion and suitable for providing comfort to a seated user's calves and feet, and wherein the bottom of the seat cushion and the bottom of the ottoman cushion are generally parallel with and in contact with the floor.

5. The seat system of claim 4 wherein the ottoman cushion is placed on top of the seat cushion to make the legless leisure chair more compact when not in use.

6. The seat system of claim 4 wherein the seat cushion and the ottoman are of a generally similar shape and proportion, though only the seat cushion has a flap, and wherein the ottoman has a friction means on its bottom to help prevent the ottoman from slipping on the floor away from the seat cushion when a user applies foot pressure that could tend to push the ottoman away from seat cushion.

7. The seat cushion of claim 1 wherein the flap has a span length measured from the bottom of the lower front cross member of the legless leisure chair to the stitch line, and wherein the span length is at least 1".

8. The seat cushion of claim 1 wherein the flap has a span length measured from the bottom of the lower front cross member of the legless leisure chair to the stitch line, and wherein the span length is between about 2" and about 4".

9. The seat system of claim 1 wherein the length of the resilient seat cushion filling measured from front to back is between about 30" and about 48" to further provide support to a user's calves and heels.

10. The seat system of claim 1 wherein the seat cushion is sewn closed along the stitch line.

11. The seat cushion of claim 1 wherein there is a piece of upholstery material separating the top and bottom of the upholstery cover on the front, left side, and right side as in a box style cushion.

12. The seat cushion of claim 1 wherein the flap is sewn in a generally tube shape, and wherein the seat cushion is attached to the lower cross member of the legless leisure chair by covering the lower cross member with the flap sewn into a generally tube shape.

13. The seat cushion of claim 1 wherein the flap is attached to the lower cross member with mechanical fasteners.

14. The seat cushion of claim 1 wherein a backrest upholstery system is attached to the lower cross member, wherein the flap on the seat cushion is attached to the backrest upholstery system, and wherein the seat cushion is attached to the lower cross member by way of the seat cushion's attachment to the backrest upholstery system.

15. The seat cushion of claim 1 wherein the cushion filling has a lower layer which is at least partially comprised of a relatively firm resilient material having an IFD of at least 40 pounds, and an upper layer made of a softer resilient material having an IFD of less than 40 pounds.

16. The seat cushion of claim 1 wherein the upholstery material comprising the top of the upholstery cover extends from the front of the seat cushion to at least the lower front cross member, and wherein the upholstery material comprising the bottom of the upholstery cover extends from the front of the seat cushion to at least the lower front cross member.

17. The seat cushion of claim 1 wherein the bottom of the upholstery cover from the front to the stitch line is free from any substantial opening means such as zippers or hook-and-loop fasteners.

18. The seat cushion of claim 1, wherein the attachment to the lower front cross member enables the seat cushion to pivot to the underside of the backrest for compact storage or shipping.

19. The seat cushion of claim 1, wherein the upholstery cover consists of:

(a) a top piece of upholstery material having a front, a back, a left side and a right side, wherein the sides have an inset toward the back, such that the width of the back is shorter than the width near the front, wherein said front, back and two sides form the perimeter of said top piece of upholstery;

b) a bottom piece of upholstery material having a front, a back, a left side and a right side, wherein the sides have an inset toward the back, such that the width of the back is shorter than the width near the front, wherein said front, back and two sides form the perimeter of said top piece of upholstery; and c) an attachment means joining the front, the left side, and the right side of the top upholstery piece to the front, the left side and the right side respectively of the bottom upholstery piece, as well as an attachment means joining the top upholstery piece and the bottom upholstery piece along the stitch line.

20. The seat cushion of claim 1 wherein the top of the resilient cushion filling defines a predominant plane of the top of the resilient cushion filling, wherein the resilient cushion filling has a predominant thickness trend from front to back, and wherein the thickness of the predominant thickness trend at the back of the resilient cushion is at least 2".

21. The seat cushion of claim 1 wherein the flap generally extends from near the top of the cushion filling.

22. The seat cushion of claim 1 wherein the flap generally extends from near the bottom of the cushion filling.

23. The seat cushion of claim 1 wherein the flap generally extends from near the middle of the cushion filling.

24. An upholstered seat system which is attached to a legless leisure chair comprising:

(a) a top piece of upholstery material having a front, a back, a left side and a right side, wherein the sides have an inset toward the back, such that the width of the back is shorter than the width near the front, wherein said front, back and two sides form the perimeter of said top piece of upholstery;

b) a bottom piece of upholstery material having a front, a back, a left side and a right side, wherein the sides have an inset toward the back, such that the width of the back is shorter than the width near the front, wherein said front, back and two sides form the perimeter of said top piece of upholstery;

c) a cushion filling having a front, a back, a top, a bottom, a left side and a right side; and d) a lower front cross portion of said legless leisure chair, legless leisure chair having a backrest frame or occupant supporting member to which said lower front cross member is attached, wherein the front, the left side, and the right side of the top upholstery are attached to the front, the left side and the right side of the bottom upholstery in such a manner that a bag is formed, wherein the cushion is inserted inside the bag formed by the top and bottom pieces of upholstery in such a manner that a portion of the upholstery material generally extending from the inset to the back of the upholstery material forms a flap, and wherein said flap is attached to the lower front cross portion of the legless leisure chair.

25. An upholstered seat system which is attached to a legless leisure chair comprising:

a) a resilient cushion filling for a seat cushion having a top, a bottom, a front, a back, a left side, and a right side, further having a size and shape suitable for providing comfort to a seated user's buttocks and thighs, wherein the top of the resilient cushion filling defines a predominant plane of the top of the resilient cushion filling, and wherein the resilient cushion filling has a predominant thickness trend from front to back;

b) an upholstery cover made of an upholstery material having a top, a bottom, a front, a back, a left side, a right side and a stitch line, and said upholstery cover further having a cavity between the top, the bottom, the front, the stitch line, the left side, and the right side, said cavity having a size and a shape similar to the resilient cushion filling, said upholstery cover further having an inside and an outside; and c) a lower front cross member on said legless leisure chair, said lower front cross member having a top and a bottom, legless leisure chair having a backrest frame or occupant supporting member to which said lower front cross member is attached, said backrest frame having a face and an underside, said backrest frame further having a backrest cushion on its face, said backrest cushion having a face and a back, said backrest cushion face having an upper portion and a lower portion, said lower portion face defining a predominant plane of the backrest cushion face lower portion;

wherein the resilient cushion filling is in the cavity of the upholstery cover such that the resilient cushion filling is covered by the upholstery cover with the top, the bottom, the front, the back, the left side, and the right side of the resilient cushion filling generally contacting the top, the bottom, the front, the stitch line, the left side, and the right side respectively of the inside of the upholstery cover, and wherein a flap is formed by the upholstery material on said upholstery cover which extends from the stitch line to the back of the upholstery cover; wherein said resilient cushion filling and said upholstery cover as described make a seat cushion with a flap, wherein the flap has a front portion and a back portion, wherein the front portion of the flap is between the stitch line of the seat cushion and the bottom of the lower front cross member of the legless leisure chair, and wherein the back portion of the flap is between the lower front cross member of the legless leisure chair and the back of the upholstery cover, wherein the back portion of the flap secures the seat cushion to the lower front cross member of the legless leisure chair with an attachment means, wherein the outside of the bottom of the upholstery cover is substantially on a floor when the legless leisure chair is positioned for use, wherein the predominant plane of the top of the resilient cushion filling intersects with the predominant plane of the lower portion of the backrest cushion face at an intersection point, and wherein there is a drop off from the predominant thickness trend of the resilient cushion filling near the intersection point such that the seat cushion is substantially thinner from the intersection point to the lower front cross member than it would be if it continued on the predominant thickness trend from the front to the back.

26. The seat cushion of claim 25 wherein the thickness of the backrest cushion on the legless leisure chair is at least about 2½ inches.

27. The seat cushion of claim 26 wherein the thickness of the seat cushion near the intersection point is between about 2½" and about 6".

* * * * *